US006598594B2

(12) United States Patent
Takahashi

(10) Patent No.: US 6,598,594 B2
(45) Date of Patent: Jul. 29, 2003

(54) FUEL SUPPLY APPARATUS

(75) Inventor: Hideto Takahashi, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/184,922

(22) Filed: Jul. 1, 2002

(65) Prior Publication Data

US 2003/0000503 A1 Jan. 2, 2003

(30) Foreign Application Priority Data

Jun. 29, 2001 (JP) ..... 2001-198537

(51) Int. Cl.[7] ..... F02M 37/04
(52) U.S. Cl. ..... 123/514; 123/510
(58) Field of Search ..... 123/514, 509, 123/516, 510; 417/80, 87, 198, 199.1

(56) References Cited

U.S. PATENT DOCUMENTS 4,842,006 A * 6/1989 Scheurenbrand et al. ... 137/202
4,886,031 A * 12/1989 Scheurenbrand et al. ... 123/516
5,139,000 A * 8/1992 Sawert ..... 123/514
5,197,444 A * 3/1993 Lang et al. ..... 123/514
5,341,842 A * 8/1994 Chih et al. ..... 137/574
5,392,750 A * 2/1995 Laue et al. ..... 123/509
5,749,345 A * 5/1998 Treml ..... 123/456
5,769,061 A * 6/1998 Nagata et al. ..... 123/509
5,960,775 A * 10/1999 Tuckey ..... 123/509
6,123,511 A * 9/2000 Sertier ..... 417/87
6,230,690 B1 5/2001 Umetsu
6,269,800 B1 * 8/2001 Fischerkeller et al. ..... 123/514
6,273,131 B1 * 8/2001 Kleppner ..... 137/565.22
6,405,717 B1 * 6/2002 Beyer et al. ..... 123/514

FOREIGN PATENT DOCUMENTS

JP 5-169989 7/1993

* cited by examiner

*Primary Examiner*—Carl S. Miller
(74) *Attorney, Agent, or Firm*—Nixon & Vanderhye P.C.

(57) ABSTRACT

A fuel supply apparatus maintains a level of fuel within a sub tank and, even if the fuel within the sub tank becomes low in volume, maintaining fuel coverage on a fuel filter is possible. A cylindrical member is formed integrally with the cover and has, at its inner bottom surface, opposite a jet pump, a fuel receiving portion for receiving fuel introduced from an introducing pipe. Above the fuel receiving portion is formed a slit-shaped opening portion which opens toward the fuel filter. The fuel fed from the jet pump passes through the introducing pipe, along the inner bottom surface, and then strikes the fuel receiving portion. The fuel then crosses over a partition wall through the opening portion located above the fuel receiving portion, and changes its direction to flow laterally to reach the top of the suction filter.

18 Claims, 4 Drawing Sheets

FUEL SUPPLY APPARATUS

CROSS REFERENCE TO RELATED APPLICATION

This application is based upon, and claims the benefit of priority of, prior Japanese Patent Application 2001-198537 filed on Jun. 29, 2001, the contents of which are incorporated herein by reference.

BACKGROUND OF THE INVENTION

1. Field of the Invention

The present invention relates to a fuel supply apparatus that draws in and discharges fuel from a jet pump to a sub tank.

2. Description of Related Art

Generally, there is known a fuel supply apparatus having a fuel pump which is housed in a sub tank that is located within a fuel tank, in which, even if a liquid level of fuel contained in the fuel tank is lowered, a level of fuel in the sub tank is maintained at a level so that the fuel can be drawn in by a fuel pump. A fuel supply apparatus of the type mentioned above operates such that when return fuel, i.e. fuel returned from an engine or the like, is fed to a jet pump, and fuel within the fuel tank is thereby drawn upward by a suction pressure produced when the fuel is injected from a jet nozzle of the jet pump, that is lower than atmospheric pressure. Then, a jet stream of the drawn fuel, together with the fuel within the fuel tank, are delivered into the sub tank. By delivering the fuel within the fuel tank into the sub tank through the jet pump, the level of the fuel within the sub tank is kept higher than the level of the fuel within the fuel tank. Consequently, even if the fuel remaining in the fuel tank becomes smaller in volume, the fuel pump is properly able to draw in and discharge the fuel within the sub tank.

Depending on a placement location or other conditions, the fuel tank may need to be made lower in profile (height). Using a low-profile fuel tank necessitates using a low-profile sub tank which is placed within the fuel tank. The shallow sub tank requires a larger bottom surface area to secure a sufficient capacity. The larger the bottom surface area of the sub tank, the larger an area of a suction filter that extends over the inner bottom portion of the sub tank. The suction filter serves to remove foreign substances entrained in the fuel when the fuel pump draws in fuel within the sub tank. If a vehicle corners or travels on steeply inclined ground with a low volume of fuel within the sub tank, a part of the suction filter may not be exposed to the fuel within the sub tank, resulting in the surface of the suction filter from running out of a liquid. This causes the fuel pump to draw in fuel and air through the suction filter. As a result, the suctioning capability and pressure-applying capability of the fuel pump are deteriorated, leading to a decrease in fuel discharge amount.

SUMMARY OF THE INVENTION

In view of the foregoing, an object of the present invention is to provide a fuel supply apparatus which is designed so that the level of the fuel within the sub tank is maintained at an appropriate level and so that running out of a liquid film on the filter is prevented even when the fuel within the sub tank is small in quantity. That is, the filter will be submerged in liquid fuel at all times, even when the volume in the tank is low in volume.

In a fuel supply apparatus according to a first aspect of the present invention, a fuel flow changing member serves to change a direction of fuel delivered from a jet pump that flows along an inner bottom surface from an upward direction into a lateral direction. This decreases the momentum of the fuel flow delivered from the jet pump to the sub tank. Since the fuel is prevented from flowing out of the sub tank, the level of the fuel within the sub tank can be maintained at an appropriate level.

Moreover, the fuel flowing upwards from the inner bottom surface changes its direction to flow sideways so as to reach the upper side of the filter. Thus, even if the fuel within the sub tank becomes smaller in volume, the filter is splashed with fuel from above. This prevents the surface of the filter from not being exposed to fuel at all times. Consequently, even if the fuel within the sub tank becomes smaller in volume, the fuel pump is properly able to draw in and discharge fuel.

In the foregoing construction description, the flow of fuel delivered from the jet pump into the sub tank may strike a fuel receiving portion, and may then be let out from an opening portion via an introducing portion. This facilitates conversion of the fuel flow direction. Moreover, by using a tubular member, the fuel flow changing member having the fuel receiving portion, the introducing portion, and the opening portion formed therein can be constructed with ease.

In the foregoing construction, a partition wall may serve to prevent the fuel from flowing into the sub tank and traveling in a direction other than a direction toward the fuel flow changing member. This will permit the fuel to flow solely toward the fuel flow changing member. Consequently, fuel is efficiently splashed on the filter. Further, fuel may be permitted to cross over the partition wall so as to flow easily toward the upper side of the filter. Thus, with a simple structure, the surface of the filter can be splashed with fuel and thereby remain covered with fuel.

In the foregoing constitution, first and second slant faces may be placed apart from each other. This allows the fuel having struck the second slant face after flowing along the first slant face to be widely scattered in the direction of the filter. Consequently, the surface of the filter not exposed to the fuel can be uniformly wetted or covered by the fuel.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Hereinafter, with reference to the accompanying drawings, preferred embodiments of the present invention will be described.

(First Embodiment)

Figure 1:
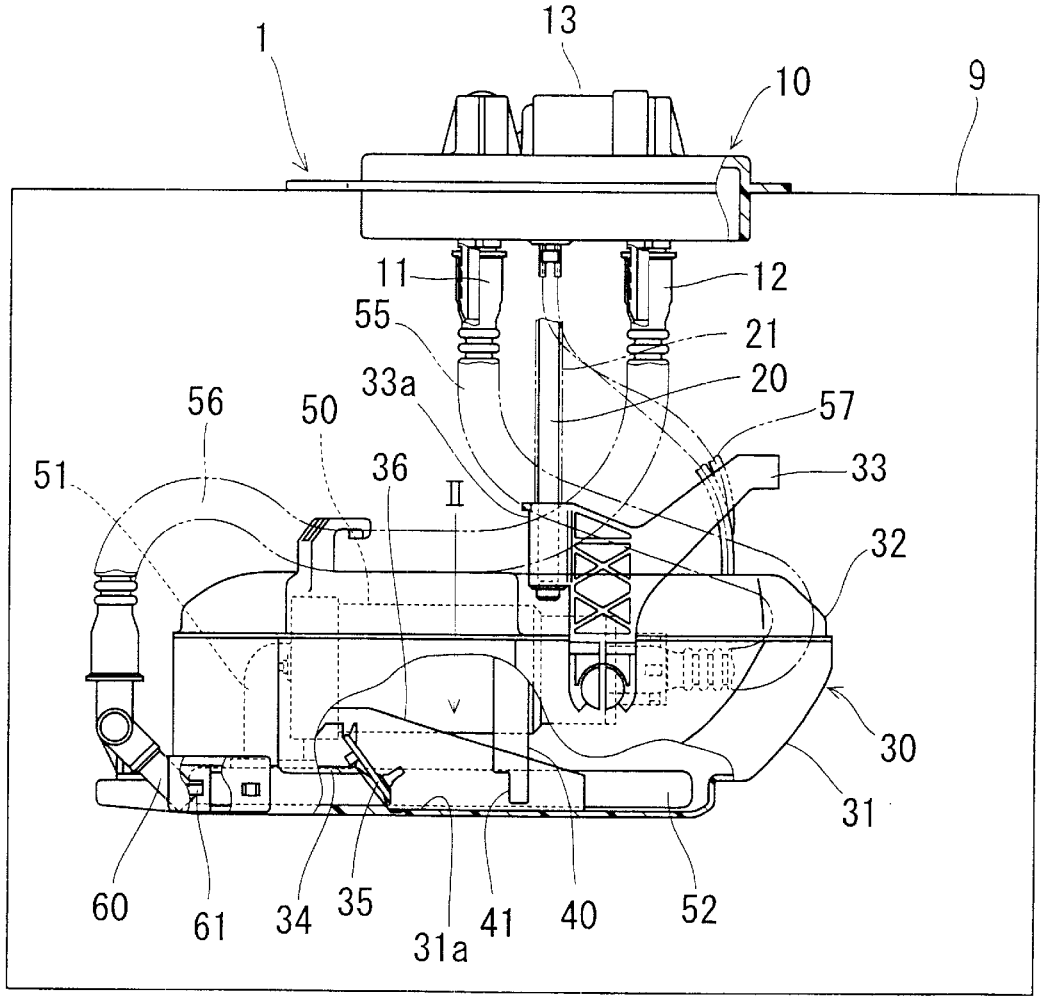
FIG. 1 is a front view showing a fuel supply apparatus according to a first embodiment of the present invention.
Figure 2:
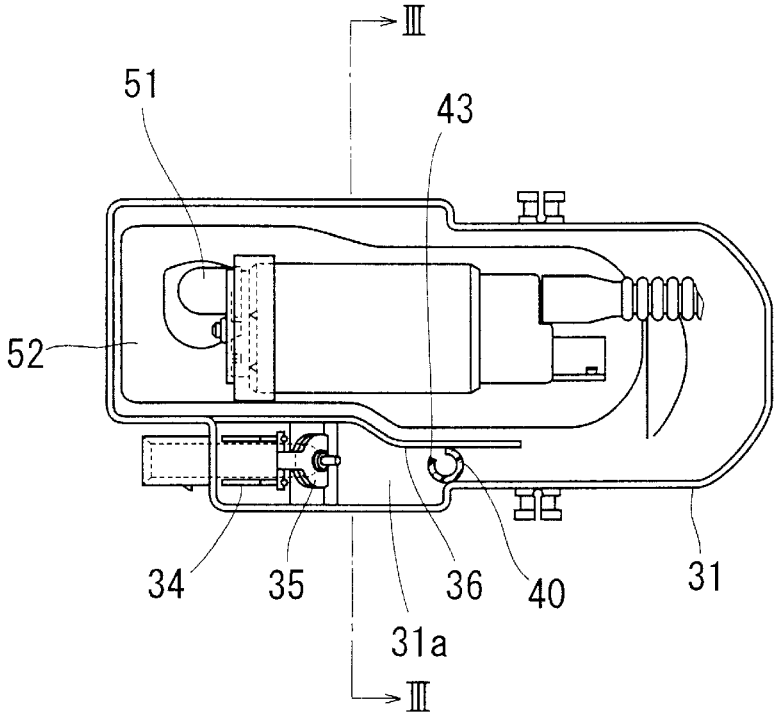
FIG. 2 is a top taken in the direction of arrow II of FIG. 1, illustrating a construction in which only a cylindrical member is sectioned at the position of an opening, and a sub tank is left uncovered.
Figure 3:
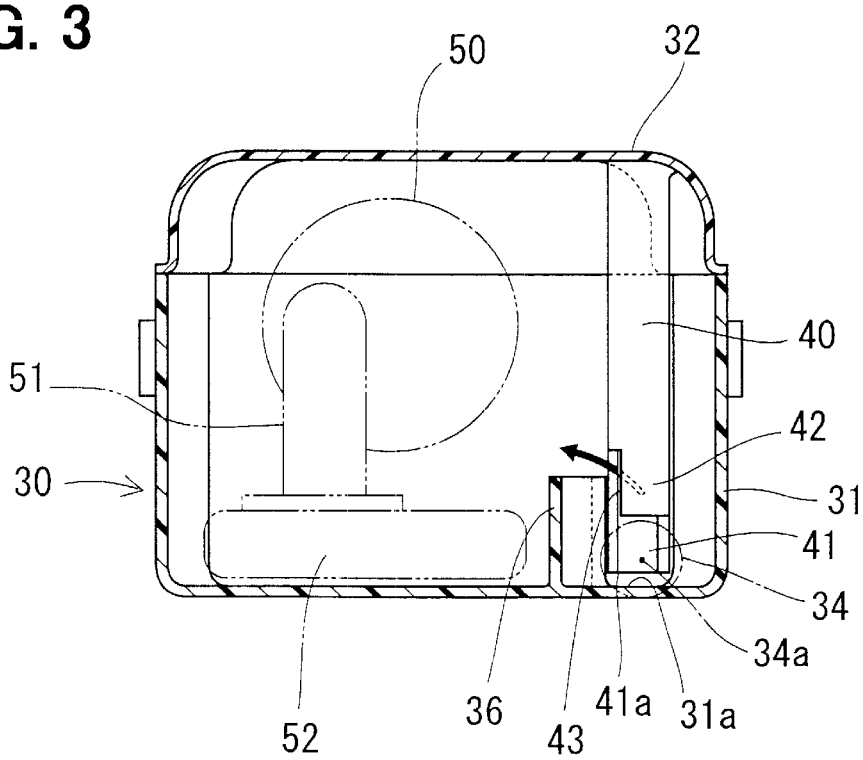
FIG. 3 is a cross-sectional view taken along the line III—III of FIG. 2.

FIGS. 1, 2, and 3 show a fuel supply apparatus in accordance with a first embodiment of the present invention. The fuel supply apparatus 1 has a flange member 10 which is attached to an upper wall of a fuel tank 9 made of resin or other material. The other components constituting the fuel supply apparatus 1 are accommodated in the fuel tank 9. The flange member 10 and a sub tank 30 are each made of resin or other material and coupled to a column support 20 made of metal. The column support 20 has one end inserted into a bottomed tubular portion (not shown) formed in the flange member 10, and has its other end inserted into a tubular portion 33*a* of a stay 33 supported by a tank case 31 of the sub tank 30. The sub tank 30 is made movable with respect to the column support 20 in the longitudinal direction of the column support 20. A coil spring 21 loads the sub tank 30 with a force that tends to move it in a direction away from the flange member 10, that is, move it toward a bottom of the fuel tank 9. In this way, the bottom portion of the sub tank 30 is kept pressed against the inner bottom surface of the fuel tank 9 in a state where the fuel supply apparatus 1 is attached to the fuel tank 9. With such a construction, even if a resin-made fuel tank 9 is expanded or contracted due to a change in its internal pressure resulting from a temperature change, or a change in the amount of fuel, the bottom portion of the sub tank 30 is constantly kept pressed against the inner bottom surface of the fuel tank by an urging force exerted by the coil spring 21.

The flange member 10 further comprises a discharge pipe 11, a return pipe 12, and an electric connector 13 that are formed integrally with one another by using resin or other bonding material. The discharge pipe 11, the return pipe 12, and the electric connector 13 may alternatively be provided as separate components and individually attached to the flange member 10. The discharge pipe 11 serves to discharge fuel discharged from a fuel pump 50 housed in the sub tank 30 to the outside of the fuel tank 9. The discharge pipe 11 is connected to the fuel pump 50 by a corrugated tube 55 which passes through a hole 32*a* formed in a cover 32. The return pipe 12 serves to return excessive fuel fed from the engine side into the fuel tank 9, and is connected to a jet pump 60 by a corrugated tube 56. The electric connector 13 serves to supply a driving current to the fuel pump 50 and to output signals detected in a level gauge (not shown). The electric connector 13, an electric portion of the fuel pump 50, and the level gage are connected to one another by a lead wire 57.

The sub tank 30 is provided with the tank case 31 and the cover 32. The tank case 31 and the cover 32 are coupled to each other by means of snap fit or other suitable fitting means. The sub tank 30 is not sealed, and the cover 32 has an opening on a part of its upper portion. An introducing pipe 34 serves to introduce fuel fed from the jet pump 60 into the tank case 31. The introducing pipe 34 has a check valve member 35 attached to the fuel outlet thereof. The check valve member 35 prevents fuel from flowing from the interior of the tank case 31 back toward the jet pump 60. Moreover, the tank case 31 has a partition wall 36 formed integrally therewith for separating a suction filter 52 from fuel flowing from the introducing pipe 34 into the tank case 31. The partition wall 36 is so shaped that its height becomes lower gradually from the jet pump 60 through the introducing pipe 34, to a cylindrical member 40.

The cylindrical member 40 acting as a fuel flow changing member, which extends from the cover 32, through an inner bottom surface 31*a* of the tank case 31, toward the periphery of the inner bottom surface 31*a*, is formed integrally with the cover 32 so as to extend perpendicularly to the inner bottom surface 31*a*. The cylindrical member 40 is partially covered with the cover 32 and has, at its inner-bottom-surface 31*a* portion opposite the jet pump 60, a fuel receiving portion 41 extending toward the inner bottom surface 31*a*, for receiving fuel introduced from the introducing pipe 34. Above the fuel receiving portion 41 is formed a slit-shaped opening portion 43 opened toward the suction filter 52, which is formed continuously with the fuel receiving portion 41. The fuel receiving portion 41 is formed of a resin pipe with its lower edge cut away. Between a lower end surface 41*a* of the fuel receiving portion 41 and the inner bottom surface 31*a* is provided a slight gap. The lower end surface 41*a* is located below a central position 34*a* of the introducing pipe 34 indicated by a dash-and-dot line in FIG. 3.

The fuel pump 50 is arranged horizontally within the sub tank 30, and draws in the fuel within the sub tank 30 from the suction filter 52 through a fuel suction pipe 51. The suction filter 52 is placed on the inner bottom portion of the tank case 31 so as to extend over the inner bottom surface 31*a*. The placement position of the suction filter 52 deviates from a flow direction of the fuel coming from the introducing pipe 34.

The jet pump 60 emits, through a jet nozzle 61, return fuel having been returned from the return pipe 12 through the corrugated tube 56. The jet pump 60 draws in the fuel within the fuel tank 9 by exploiting a suction pressure produced by a jet of the fuel that is lower than an atmospheric pressure, and then allows the fuel to pass through the introducing pipe 34, along the inner bottom surface 31*a* of the tank case 31, so as to be delivered into the cylindrical member 40.

Next, the working of the fuel supply apparatus 1 will be described. When the engine is driven to operate and a driving current is supplied from the electric connector 13 to the fuel pump 50, the fuel pump 50 draws in fuel within the sub tank 30 through the suction filter 52 and then, after removal of foreign substances by the suction filter 52, discharges the fuel through the discharge pipe 11 toward the engine.

The fuel having been returned from the engine side to the corrugated tube 56 through the return pipe 12 passes through the jet pump 60, and is thereafter jetted into the sub tank 30. Thereupon, a suction pressure is produced and the fuel within the fuel tank 9 is drawn up. By the injection pressure of the jet pump 60, the fuel within the fuel tank 9 is delivered from the introducing pipe 34, along the inner bottom surface 31*a*, and into the sub tank 30. Since the fuel flowing from the introducing pipe 34 into the sub tank 30 and the suction filter 52 are separated from each other by the partition wall 36, the fuel flows along the inner bottom surface 31*a* and toward the cylindrical member 40.

A portion of the fuel directed to the cylindrical member 40 passes through the region between the lower end surface 41*a* of the fuel receiving portion 41 and the inner bottom surface 31*a* so as to be let out over the cylindrical member 40, as viewed from the introducing pipe 34. That is, upon introduction of fuel into the sub tank 30 for the first time after a vehicle is assembled, the fuel passes through the region between the lower end surface 41*a* and the inner bottom surface 31*a* so as to reach the suction filter 52. Since the central position 34*a* of the introducing pipe 34 is located above the lower end surface 41*a,* the remaining fuel to be delivered from the introducing pipe 34 to the cylindrical member 40 strikes the fuel receiving portion 41 of the cylindrical member 40 causing the fuel flow to lose its momentum.

At this time the fuel, having lost its momentum as a result of the collision with the fuel receiving portion 41, is directed upward within the cylindrical member 40. However, the fuel cannot flow upwards to reach the upper part of the cylindrical member 40. Then, the fuel is directed, via an introducing portion 42 located above the fuel receiving portion 41, to the opening portion 43. Thereafter, the fuel crosses over the partition wall 36 and changes its direction to travel sideways so as to reach the upper side of the suction filter 52 to be let out from the cylindrical member 40. Since the upper part of the opening portion 43 is located above the upper end of the partition wall 36, it is possible to ensure that the fuel discharged from the opening portion 43 crosses over the partition wall 36 so as to be splashed on the suction filter 52.

Since the fuel fed from the jet pump 60 is delivered through the opening portion 43 of the cylindrical member 40 into the sub tank 30, the level of the fuel within the sub tank 30 is raised with respect to the exterior of the sub tank 30, and is maintained at a predetermined height. Consequently, even if no fuel remains around the jet pump 60 as a result of the vehicle's cornering or running on steeply inclined ground under the condition in which the level of the fuel within the fuel tank is lowered, the fuel pump 50 is able to draw in the fuel within the sub tank 30 without causing improper fuel suctioning, thereby making it possible to continuously supply fuel to the engine.

Even if the sub tank 30 is made smaller in depth, the fuel fed from the jet pump 60 is permitted to strike the fuel receiving portion 41, causing the fuel flow to lose its momentum. Consequently, the fuel is prevented from crossing over the tank case 31 and flowing out of the sub tank 30 through the hole 32*a*. Moreover, when a part of the suction filter 52 is exposed due to a shortage of fuel within the tank case 31, fuel is splashed on the suction filter 52 through the opening portion 43, and thereby the surface of the suction filter 52 is kept wet (the outer surface is kept wet with fuel). Since the fuel pump 50 is designed not to draw in air together with fuel through the suction filter 52, the fuel pump 50 is able to draw in and discharge a desired amount of fuel.

(Second Embodiment)

Figure 4:
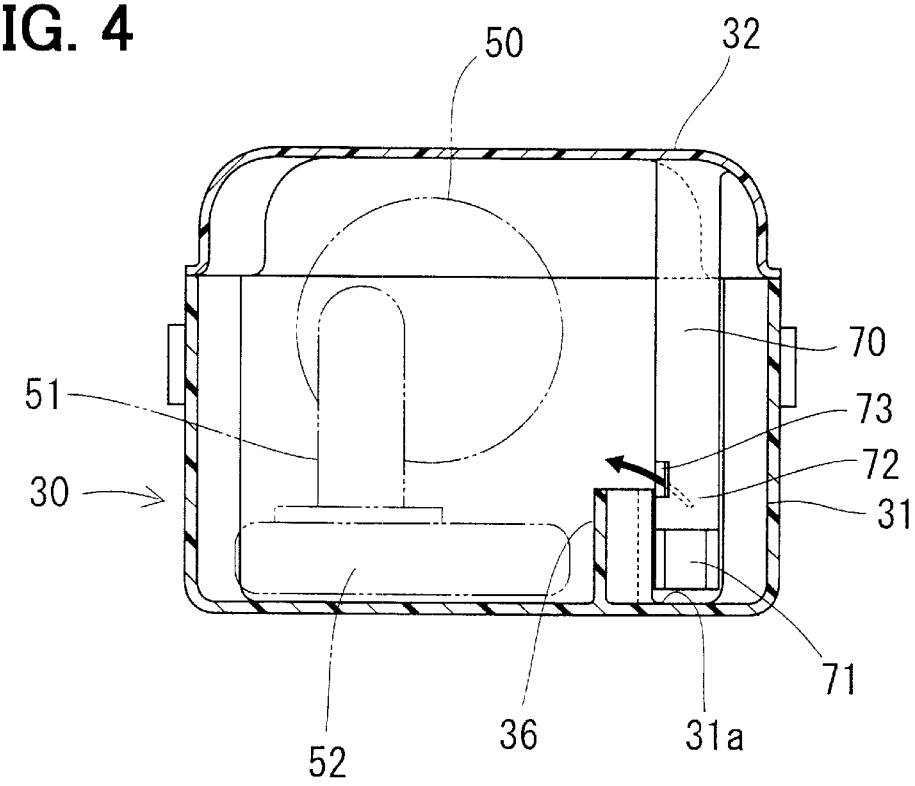
FIG. 4 is a cross-sectional view showing the fuel supply apparatus according to a second embodiment of the present invention, as viewed at the same plane of section as in FIG. 3.

FIG. 4 shows a second embodiment of the present invention. In the second embodiment, a cylindrical member 70, provided as a fuel flow changing member, is so designed that a fuel receiving portion 71 and an opening portion 73 are not formed continuously with each other. An upper part of the opening portion 73 is located above the upper end of the partition wall 36. The fuel, having struck the fuel receiving portion 71, is directed through an introducing portion 72 located above the fuel receiving portion 71, to the opening portion 73. Otherwise, the second embodiment is substantially identical to the first embodiment.

(Third Embodiment)

Figure 5:
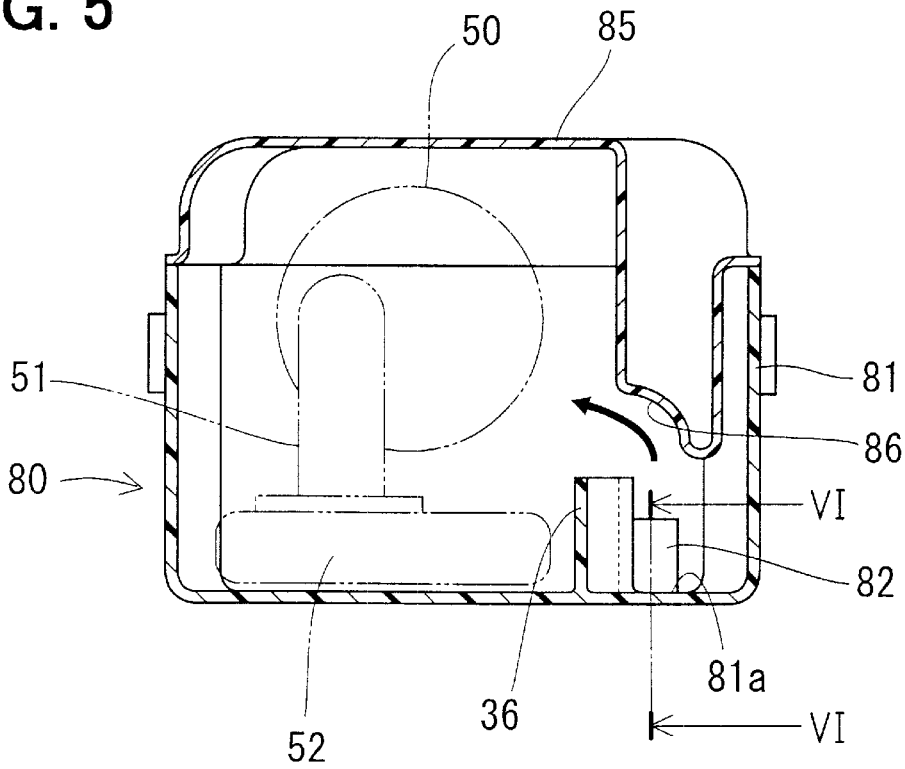
FIG. 5 is a cross-sectional view showing the fuel supply apparatus according to a third embodiment of the present invention, as viewed at the same plane of section as in FIG. 3.
Figure 6:
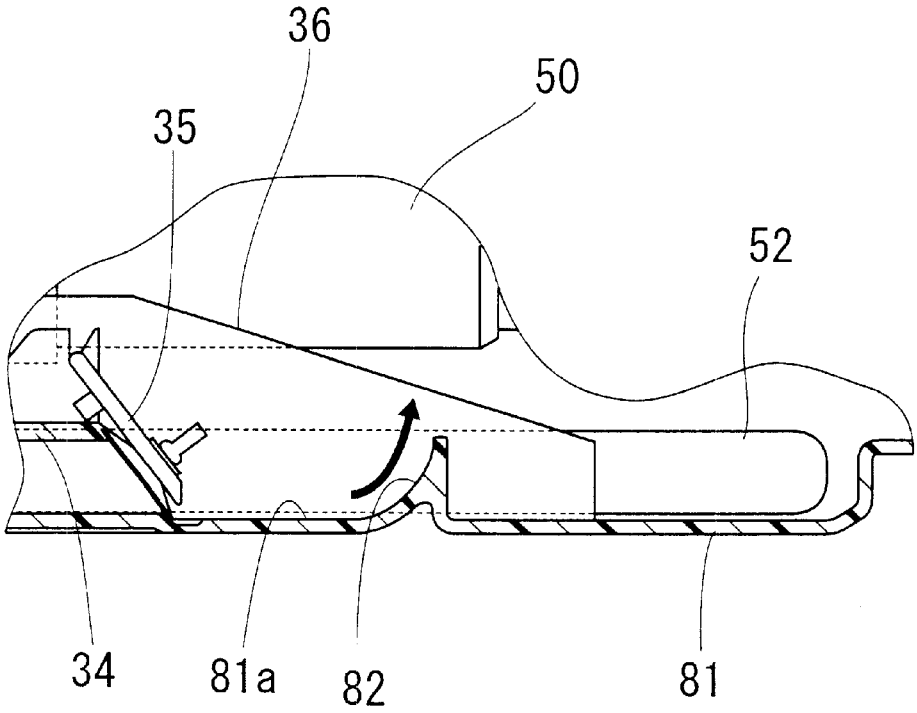
FIG. 6 is a cross-sectional view taken along the line VI—VI of FIG. 5.

FIGS. 5 and 6 show a third embodiment of the present invention. A sub tank 80 is provided with a tank case 81 and a cover 85. The tank case 81 has a first slant face 82 which is so formed as to extend in a direction in which fuel flows from the introducing pipe 34 along an inner bottom surface 81*a* of the tank case 81 and obliquely upwards from the inner bottom surface 81*a*.

The cover 85 has a second slant face 86 which is formed at a position to which the fuel flowing obliquely upwards from the inner bottom surface 81*a* along the first slant surface 82 is directed. The second slant face 86 serves to change the direction of the flow of the fuel so that the fuel travels sideways so as to reach the suction filter 52. The first and second slant faces 82 and 86 each constitute a part of the fuel flow changing member.

Since the first and second slant faces 82 and 86 are located away from each other, in a state where the fuel within the tank case 81 is small in quantity, the fuel traveling obliquely upwards by the guide of the first slant face 82 strikes the second slant face 86. The fuel having struck the second slant face 86 is splashed and scattered toward the upper side of the suction filter 52, thereby allowing the surface of the suction filter 52 exposed from the fuel within the tank case 81 to be thoroughly wetted.

In the plurality of embodiments described thus far, the flow direction of the fuel delivered from the jet pump 60 into the sub tank 30 changed by the fuel flow changing member from an upward direction to a lateral direction. Thus, the fuel directed from the jet pump 60 into the sub tank 30 is prevented from leaking out of the sub tank 30, thereby making it possible to secure a sufficient amount of fuel in the sub tank 30.

Moreover, if the fuel within the sub tank 30 becomes smaller in volume, the suction filter 52 is not exposed to the fuel. In this case, the surface of the suction filter 52 is wetted by the fuel flowing sideways toward the upper side of the suction filter 52, thereby creating a liquid fuel film on the surface of the suction filter 52. Thus, even if the fuel within the sub tank becomes small in volume, the fuel pump 50 never draws in air through the suction filter 52. Consequently, it is possible to draw in and discharge the required amount of fuel.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel supply apparatus comprising:

a sub tank housed in a fuel tank;

a jet pump for drawing fuel contained in the fuel tank by suction produced when fuel is injected from a jet nozzle, and for delivering the fuel into the sub tank along an inner bottom surface of the sub tank;

a fuel pump housed in the sub tank, for drawing in and discharging the fuel contained in the sub tank;

a filter disposed on the inner bottom surface of the sub tank, for removing foreign substances in the fuel within the sub tank that are drawn in by the fuel pump;

a fuel flow changing member for changing a direction of the fuel delivered from the jet pump and flowing along the inner bottom surface so that the fuel is directed away from the inner bottom surface, and for changing a direction of the fuel flowing away from the inner bottom surface so that the fuel is directed parallel to the inner bottom surface to reach a portion of the filter farthest from the inner bottom surface; and a check valve provided at a fuel outlet of the jet pump.

2. The fuel supply apparatus according to claim 1, wherein the fuel flow changing member is a tubular member with an opening at its end closest to the inner bottom surface, the tubular member being arranged substantially perpendicular to the inner bottom surface, the tubular member including:

a fuel receiving portion provided at its end closest to the inner bottom surface and opposite the jet pump so as to extend toward the inner bottom surface, upon which fuel delivered from the jet pump impinges;

an opening portion provided above the fuel receiving portion, for allowing the fuel, which has been changed in its direction to flow upwards by impinging upon the fuel receiving portion, then be directed from the tubular member in a lateral direction so as to reach the top side of the filter; and an introducing portion for transferring fuel from the fuel receiving portion to the opening portion.

3. The fuel supply apparatus according to claim 2, further comprising:

a partition wall for separating fuel delivered into the sub tank by the jet pump from the filter and guiding the fuel to the fuel flow changing member, wherein the opening portion continues along the cylindrical member above an upper end of the partition wall.

4. The fuel supply apparatus according to claim 1, wherein the fuel flow changing member includes:

a first slant face extending, in a direction which fuel delivered from the jet pump flows, obliquely upwards from the inner bottom surface; and a second slant face for changing a direction of the fuel, which has been changed in its direction by the first slant face to flow obliquely upwards, so that the fuel is directed laterally so as to reach the upper side of the filter.

5. The fuel supply apparatus according to claim 1, further comprising:

a partition wall for separating fuel delivered into the sub tank by the jet pump from the filter and guiding the fuel to the fuel flow changing member.

6. The fuel supply apparatus according to claim 2, further comprising:

a partition wall for separating fuel delivered into the sub tank by the jet pump from the filter and guiding the fuel to the fuel flow changing member.

7. The fuel supply apparatus according to claim 4, further comprising:

a partition wall for separating fuel delivered into the sub tank by the jet pump from the filter and guiding the fuel to the fuel flow changing member.

8. A fuel supply apparatus comprising:

a sub tank housed in a fuel tank;

a jet pump for drawing fuel contained in the fuel tank by suction produced when fuel is injected from a jet nozzle, and for delivering the fuel into the sub tank along an inner bottom surface of the sub tank;

a fuel pump housed in the sub tank, for drawing in and discharging the fuel contained in the sub tank;

a filter disposed on the inner bottom surface of the sub tank, for removing foreign substances in the fuel within the sub tank that are drawn in by the fuel pump; and a fuel flow changing member for changing a direction of the fuel delivered from the jet pump and flowing along the inner bottom surface so that the fuel is directed away from the inner bottom surface, and for changing a direction of the fuel flowing away from the inner bottom surface so that the fuel is directed parallel to the inner bottom surface to reach a portion of the filter farthest from the inner bottom surface, wherein the fuel flow changing member is a tubular member with an opening at its end closest to the inner bottom surface, the tubular member being arranged substantially perpendicular to the inner bottom surface, the tubular member including:

a fuel receiving portion provided at its end closest to the inner bottom surface and opposite the jet pump so as to extend toward the inner bottom surface, upon which fuel delivered from the jet pump impinges, an opening portion provided above the fuel receiving portion, for allowing the fuel, which has been changed in its direction to flow upwards by impinging upon the fuel receiving portion, then be directed from the tubular member in a lateral direction so as to reach the top side of the filter; and an introducing portion for transferring fuel from the fuel receiving portion to the opening portion, and the fuel supply apparatus further comprising:

a partition wall for separating fuel delivered into the sub tank by the jet pump from the filter and guiding the fuel to the fuel flow changing member, wherein the opening portion continues along the cylindrical member above an upper end of the partition wall.

9. A fuel supply apparatus comprising:

a sub tank housed in a fuel tank;

a jet pump for drawing fuel contained in the fuel tank by suction produced when fuel is injected from a jet nozzle, and for delivering the fuel into the sub tank along an inner bottom surface of the sub tank;

a fuel pump housed in the sub tank, for drawing in and discharging the fuel contained in the sub tank;

a filter disposed on the inner bottom surface of the sub tank, for removing foreign substances in the fuel within the sub tank that are drawn in by the fuel pump; and a fuel flow changing member for changing a direction of the fuel delivered from the jet pump and flowing along the inner bottom surface so that the fuel is directed away from the inner bottom surface, and for changing a direction of the fuel flowing away from the inner bottom surface so that the fuel is directed parallel to the inner bottom surface to reach a portion of the filter farthest from the inner bottom surface, wherein the fuel flow changing member includes:

a first slant face extending, in a direction which fuel delivered from the jet pump flows, obliquely upwards from the inner bottom surface; and a second slant face for changing a direction of the fuel, which has been changed in its direction by the first slant face to flow obliquely upwards, so that the fuel is directed laterally so as to reach the upper side of the filter.

10. A fuel supply apparatus comprising:

a sub tank housed in a fuel tank;

a jet pump for drawing fuel contained in the fuel tank by suction produced when fuel is injected from a jet nozzle, and for delivering the fuel into the sub tank along an inner bottom surface of the sub tank;

a fuel pump housed in the sub tank, for drawing in and discharging the fuel contained in the sub tank;

a filter disposed on the inner bottom surface of the sub tank, for removing foreign substances in the fuel within the sub tank that are drawn in by the fuel pump;

a fuel flow changing member for changing a direction of the fuel delivered from the jet pump and flowing along the inner bottom surface so that the fuel is directed away from the inner bottom surface, and for changing a direction of the fuel flowing away from the inner bottom surface so that the fuel is directed parallel to the inner bottom surface to reach a portion of the filter farthest from the inner bottom surface, and a partition wall for separating fuel delivered into the sub tank by the jet pump from the filter and guiding the fuel to the fuel flow changing member.

11. A fuel supply apparatus comprising:

a sub tank housed in a fuel tank;

a jet pump for drawing fuel contained in the fuel tank by suction produced when fuel is injected from a jet nozzle, and for delivering the fuel into the sub tank along an inner bottom surface of the sub tank;

a fuel pump housed in the sub tank, for drawing in and discharging the fuel contained in the sub tank;

a filter disposed on the inner bottom surface of the sub tank, for removing foreign substances in the fuel within the sub tank that are drawn in by the fuel pump; and a fuel flow changing member for changing a direction of the fuel delivered from the jet pump and flowing along the inner bottom surface so that the fuel is directed away from the inner bottom surface, and for changing a direction of the fuel flowing away from the inner bottom surface so that the fuel is directed parallel to the inner bottom surface to reach a portion of the filter farthest from the inner bottom surface;

wherein the fuel flow changing member is a tubular member with an opening at its end closest to the inner bottom surface, the tubular member being arranged substantially perpendicular to the inner bottom surface, the tubular member including:

a fuel receiving portion provided at its end closest to the inner bottom surface and opposite the jet pump so as to extend toward the inner bottom surface, upon which fuel delivered from the jet pump impinges, an opening portion provided above the fuel receiving portion, for allowing the fuel, which has been changed in its direction to flow upwards by impinging upon the fuel receiving portion, then be directed from the tubular member in a lateral direction so as to reach the top side of the filter; and an introducing portion for transferring fuel from the fuel receiving portion to the opening portion, and the fuel supply apparatus further comprising: a partition wall for separating fuel delivered into the sub tank by the jet pump from the filter and guiding the fuel to the fuel flow changing member.

12. The fuel supply apparatus according to claim 9, further comprising:

a partition wall for separating fuel delivered into the sub tank by the jet pump from the filter and guiding the fuel to the fuel flow changing member.

13. A fuel supply apparatus comprising:

a sub tank housed in a fuel tank;

a jet pump for drawing fuel contained in the fuel tank by suction produced when fuel is injected from a jet nozzle, and for delivering the fuel into the sub tank along an inner bottom surface of the sub tank;

a fuel pump housed in the sub tank, for drawing in and discharging the fuel contained in the sub tank;

a filter disposed on the inner bottom surface of the sub tank, for removing foreign substances in the fuel within the sub tank that are drawn in by the fuel pump; and a fuel flow changing member for changing a direction of the fuel delivered from the jet pump and flowing along the inner bottom surface so that the fuel is directed away from the inner bottom surface, and for changing a direction of the fuel flowing away from the inner bottom surface so that the fuel is directed parallel to the inner bottom surface to reach a portion of the filter farthest from the inner bottom surface, wherein the fuel flow changing member extends from a cover of the sub tank toward the inner bottom surface and defines an open portion at its end for guiding, to the filter, fuel that strikes a receiving portion, and between a fuel outlet of the jet pump and the fuel flow changing member, a fuel passage is defined that is substantially parallel to the inner bottom surface.

14. The fuel supply apparatus according to claim 13, further comprising:

an introduction pipe extending substantially parallel to the inner bottom surface between a fuel outlet of the jet pump and a check valve.

15. The fuel supply apparatus according to claim 13, wherein a clearance is defined between the fuel flow changing member and the inner bottom surface.

16. The fuel supply apparatus according to claim 13, wherein the fuel pump is provided substantially parallel to the inner bottom surface.

17. The fuel supply apparatus according to claim 13, wherein a longitudinal axis of the filter is substantially parallel to the inner bottom surface.

18. The fuel supply apparatus according to claim 13, wherein a longitudinal axis of the sub tank is substantially parallel to a bottom surface of the fuel tank.

* * * * *